US005266923A

United States Patent [19]

Tseng

[11] Patent Number: 5,266,923

[45] Date of Patent: * Nov. 30, 1993

[54] ANTI-TAMPER LOCKING MECHANISM

[76] Inventor: Chiang S. Tseng, 9780 Capella Drive, Richmond, British Columbia, Canada, V6X 3N4

[ * ] Notice: The portion of the term of this patent subsequent to May 4, 2010 has been disclaimed.

[21] Appl. No.: 691,367

[22] Filed: Apr. 25, 1991

[51] Int. Cl.[5] ..... E05B 45/06; H01H 27/06

[52] U.S. Cl. ..... 340/542; 70/DIG. 49; 200/61.66

[58] Field of Search ..... 340/542; 70/DIG. 49, 70/419, 441; 200/61.66-61.68, 252, 260, 336, 273-274

[56] References Cited

U.S. PATENT DOCUMENTS 3,596,014 7/1971 Erez ..... 200/61.66 X
3,986,376 10/1976 Lack ..... 70/419 X
4,186,578 2/1980 Sommer ..... 70/419
4,205,542 6/1980 Renda ..... 70/441 X
4,262,506 4/1981 Töbel ..... 70/419

*Primary Examiner*—John K. Peng
*Assistant Examiner*—Thomas J. Mullen, Jr.
*Attorney, Agent, or Firm*—Claude A. S. Hamrick; Craig P. Opperman; Robert O. Guillot

[57] ABSTRACT

An improved locking mechanism having a first electrode carried by at least one of the locking elements and a second electrode carried by the locking surface normally engageable by the locking elements when the locking mechanism is in its locked configuration, and an electrical tamper-detection circuit connected across the first and second electrodes and operative to generate an electrical signal response in the event that the first electrode is caused to engage the second electrode.

6 Claims, 3 Drawing Sheets

ANTI-TAMPER LOCKING MECHANISM

BACKGROUND OF THE INVENTION

1. Field of the Invention

The present invention relates generally to locking mechanisms and more particularly to an improved locking mechanism having means for detecting an attempted defeat of the lock by the insertion and turning of an unauthorized key or foreign object into the key slot and for generating a signal evidencing the violation.

2. Brief Description of the Prior Art

Inexpensive locking devices including pin tumbler, wafer-tumbler, disk-tumbler and Bramah type locks can be easily defeated by the manipulation of a properly constructed pick inserted into the looked keyway. Various means have thus heretofore been proposed to make it more difficult for such locks to be successfully opened by means other than a properly coded key. Furthermore, proposals have been made to distinguish between authorized and unauthorized objects inserted into the locked keyway for detecting a tamper attempt and providing a suitable response such as the activating of an alarm or the inhibiting of further lock movement.

One such approach is disclosed in the U.S. Patent to Frederick A. Sommer (U.S. Pat. No. 4,186,578) and includes the connection of an electrical circuit between two adjacent pin tumblers which are electrically insulated from the cylinder such that when the contacts are bridged by an electrical conductor such as a lock pick or the metal key, an electrical path is completed to produce the appropriate response to the tamper attempt. However, the problem with such apparatus is that it requires the use of a key made of plastic or other nonconductive material.

Another attempt to provide a means for detecting entry or drilling attempts into cylinder locks is disclosed in the U.S. Patent to Tobel (U.S. Pat. No. 4,262,506) and includes spring-biased tripping pins connected to an alarm or indicator system to detect a space in the rotated cylinder bore left unoccupied by insertion of an improperly made key or the removal of the cylinder. This approach has the disadvantage that it is only applicable to certain types of locks and does not provide a universal solution to the problem.

SUMMARY OF THE INVENTION

It is therefore a principal object of the present invention to provide a universal solution to the problem of detecting lock tampering from the very instant that the tamper attempt begins rather than after the lock has been opened.

Another object of the present invention is to provide a simple modification that can be made to any tumbler-type locking design to provide an instantaneous indication of a tamper attempt.

Briefly, a presently preferred embodiment of the present invention includes the provision of conductive electrodes positioned to be engaged by the tumblers in the event of an unauthorized attempt to open the lock. An electrical circuit connected between the electrodes and the tumblers, or other conductive portions of the locking mechanism, activates a signal evidencing the attempted defeat of the lock.

An important advantage of the present invention is that it can be applied to a wide variety of lock designs and requires only a minimal modification thereof.

Another advantage of the present invention is that it signals an attempted defeat as soon as any normal unlocking force is applied to the locking mechanism.

These and other objects and advantages of the present invention will no doubt become apparent to those skilled in the art after having read the following detailed description of the present invention disclosed in the several figures of the drawing.

IN THE DRAWING

DESCRIPTION OF THE PREFERRED EMBODIMENTS

Figure 1:
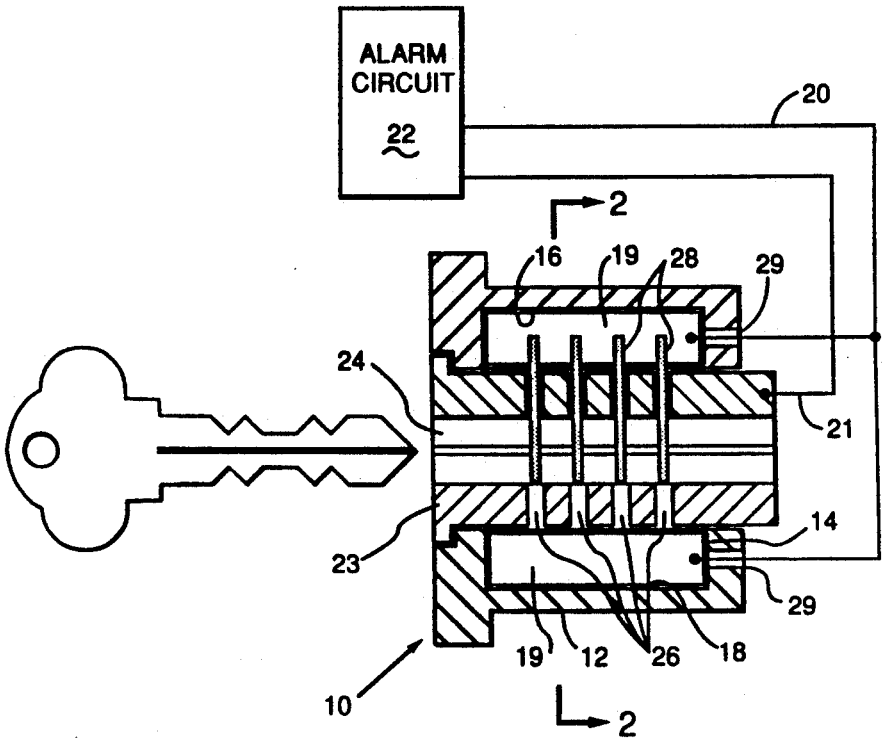
FIG. 1 is an axial cross-sectional view taken through an anti-tamper lock mechanism in accordance with the present invention shown with a schematic representation of an accompanying alarm signal circuitry and showing the key removed.

Referring now to FIG. 1 of the drawing, a conventional wafer-tumbler locking mechanism modified in accordance with the present invention is illustrated at 10. The mechanism includes a cylindrical outer housing 12 having an axial bore 14 with longitudinally extending slots 16 and 18 formed therein on opposite sides of the bore. Disposed within each slot are conductive electrodes in the form of thin metallic strips or channels 19 electrically insulated from the metallic housing 12 and jointly connected to one input 20 of an electrical alarm circuit 22. Disposed within bore 14 is a lock cylinder 23 having a key slot 24 extending longitudinally therealong and having transversely extending slots 26 forming passageways thereacross for slidably receiving wafer tumblers 28. Cylinder 23 is electrically connected to a second input 21 of alarm circuit 22.

Figure 2:
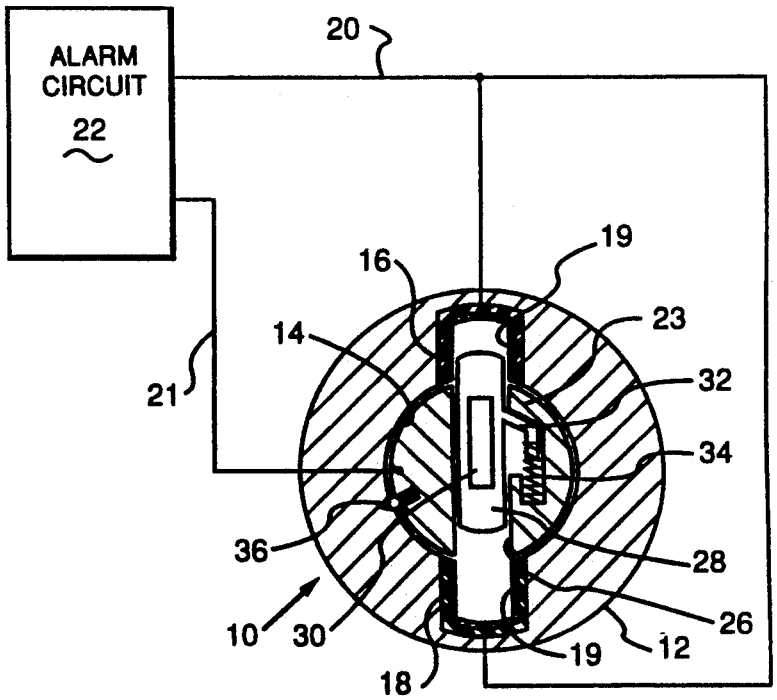
FIG. 2 is a transverse cross-sectional view taken along the line 2—2 of FIG. 1.

As is more clearly depicted in FIG. 2 of the drawing, which is a transverse cross-section taken along the line 2—2 in FIG. 1, the wafer tumblers 28 are flat, generally rectangular bodies having a key slot 30 formed therein and have a length equal to the outside diameter of cylinder 23. Each tumbler also has a laterally extending tab 32 that engages a spring 34 which serves to bias the tumbler in one direction or another such that, when the cylinder is aligned as indicated, the tumblers will extend into one of the slots 16.

Note that the transverse width of the slots 16 is substantially greater than the width of the tumblers 28, so that when the cylinder 23 is properly within its neutral position and maintained therein by a spring-loaded ball and detent-centering device shown at 36, no tumbler Will engage one of the electric contact strips 19. The slots 16 and tumblers 28 otherwise interrelate in the well-known classical manner to prevent rotation of the locked cylinder 23 absent insertion of an authorized key.

In the event that one were to tamper with the lock and attempt to turn the cylinder 23 without having first inserted a key that properly retracts all of the tumblers, any unretracted tumbler will engage a contact strip 19 and complete an electrical circuit through the alarm device 22.

Figure 3:
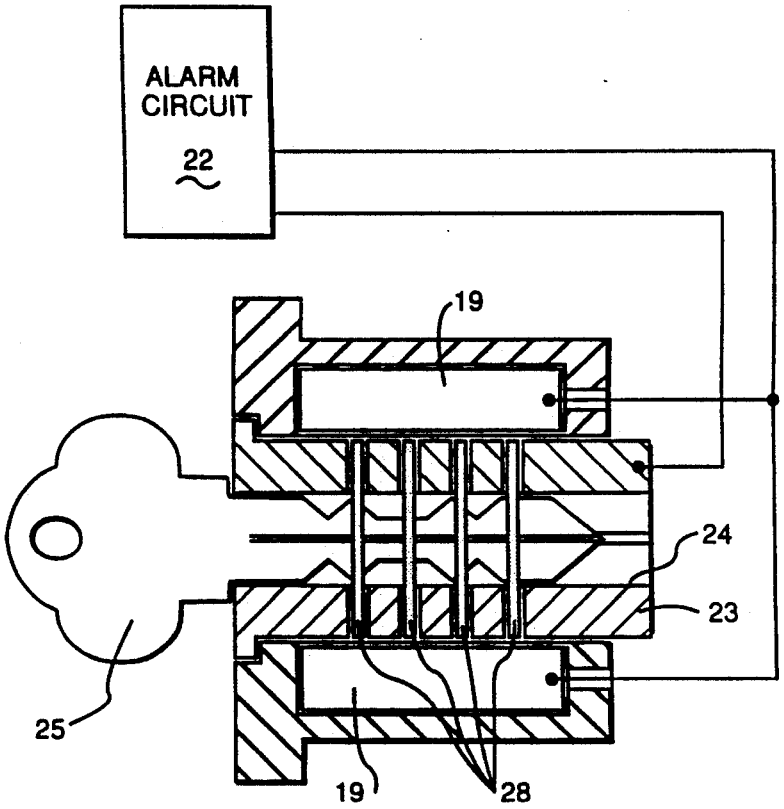
FIG. 3 is an axial cross-sectional view similar to that of FIG. 1 showing an authorized key inserted into the lock.
Figure 4:
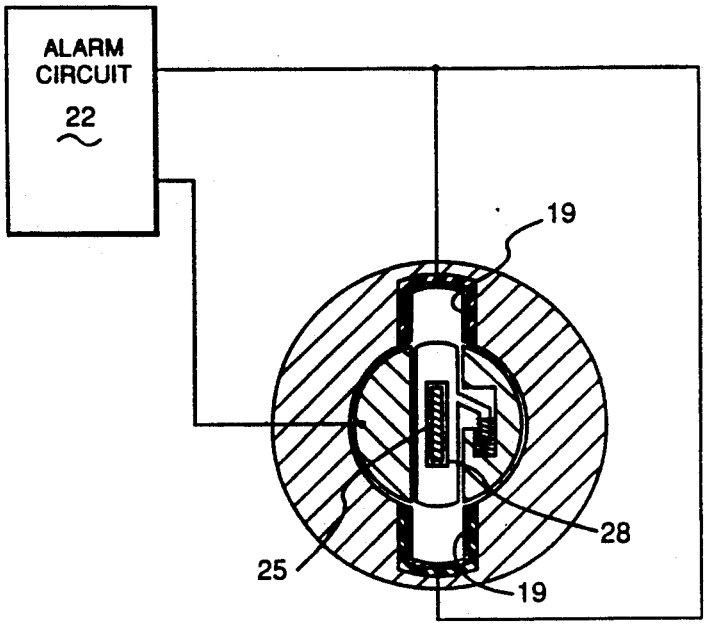
FIG. 4 is a transverse cross-sectional view taken along the line 4—4 of FIG. 3 and showing the wafer tumbler retracted by the insertion of an authorized key.

Turning now to FIG. 3 of the drawing, it will be noted that when an authorized key 25 is inserted into the keyway 24, each of the tumblers 28 is retracted into cylinder 23 and the cylinder is free to turn without sounding an alarm since no tumbler will engage an electrode 19. As indicated in FIG. 4, once retracted by an authorized key 25 inserted through the openings 28, no tumbler will project outside the outer diameter of cylinder 23 and thus cannot contact one of the electrodes 19 to set off a tamper alarm.

Note that in this type of lock the only material modification required to allow incorporation of the present invention is to increase the width of slots 16 enough to accommodate the electrodes 19 which are adhered to the slot walls by a suitable layer of insulative adhesive (FIG. 2). The electrical leads leading to electrodes 19 can be passed through small apertures 29 bored in the back side of housing 12 and aligned with each electrode end. The circuit wires can then be inserted through the apertures 29 to couple the electrodes 19 to the circuit input 20. The common or ground lead 21 may be connected to any conductive part of the housing 12 or the locking cylinder 23 so long as a conductive path is provided from the contact point to the metallic wafer tumblers 28.

Figure 5:
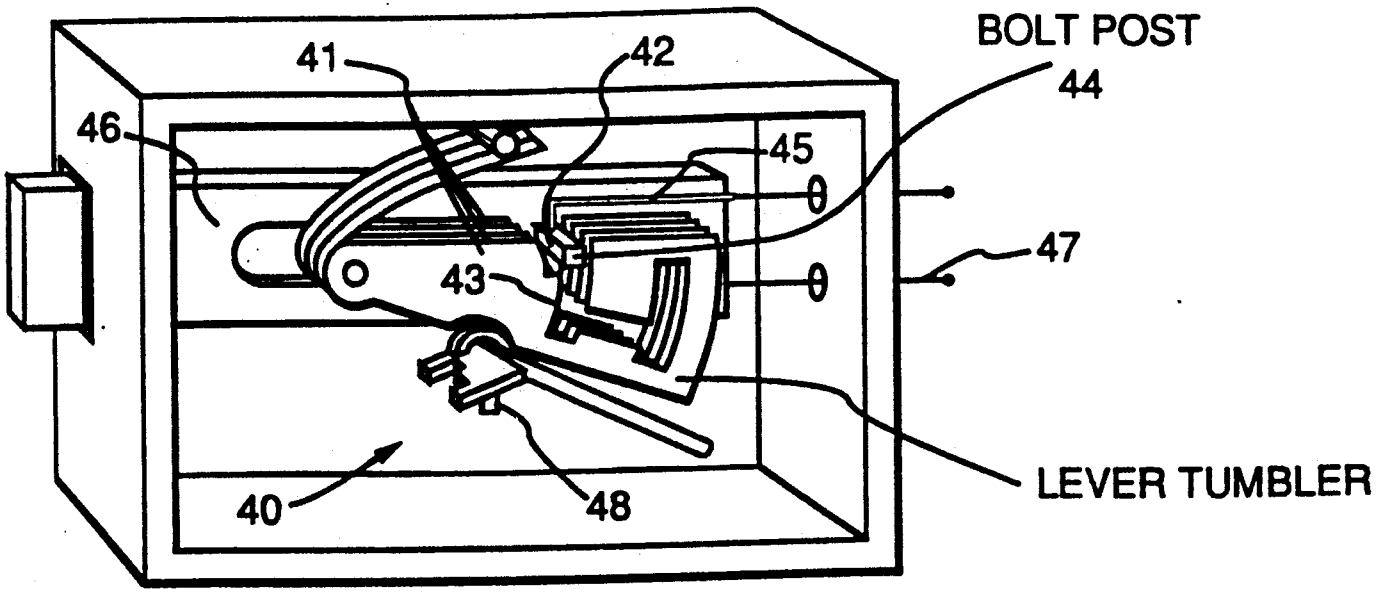
FIG. 5 is a pictorial view illustrating application of the present invention to a lever-tumbler-type lock.

Turning now to FIG. 5 of the drawing, application of the present invention to a substantially different type of locking mechanism is illustrated. In this embodiment, the present invention is incorporated in a lever-tumbler locking mechanism 40 including a plurality of tumblers 41 by simply providing an electrically isolated conductive electrode 42 along each side of the bolt post 44 with an insulated lead 45 providing a first circuit connector. A second or ground connector 47 can then be connected directly to bolt 46. Alternatively, the electrodes 42 could be positioned along the edges of the tumbler slots 43. The insertion of an unauthorized key or picking tool into the keyhole 48 tending to cause the bolt 46 to move will cause the bolt post 44 to engage at least one of the tumblers 41 and actuate an alarm in a manner similar to that described earlier with regard to the embodiment of FIGS. 1-4.

It will thus be appreciated by those skilled in the art that a similar alteration of any tumbler-type, or other similar locking mechanism can be made in accordance with the present invention with similar results being enjoyed.

Although the present invention has been disclosed with regard to only some of the many types of locking mechanisms, it will be appreciated that many alterations and modifications of the invention will be apparent to the skilled lock designer. It is therefore intended that the following claims be interpreted as covering all such alterations and modifications as fall within the true spirit and scope of the invention.

What is claimed is:

1. An improved locking mechanism comprising:

a fixed body with a circular chamber formed therein;

a plurality of radially oriented slots formed in the walls of said circular chamber, each slot having two opposing, spaced apart, radially oriented sidewalls;

a cylinder mounted within said chamber for rotational movement relative to said fixed body and operative to perform a locking function;

a plurality of locking elements for individual movement between a first position in which rotation of said cylinder relative to said fixed body is prevented by engagement of at least one of said locking elements with at least one of said slots, and a second position in which no locking element engages any of said slots and movement between said cylinder and said fixed body is permitted;

first electrode means formed by at least one of said locking elements, second electrode means disposed along both the sidewalls of at least two of said slots, at least one of said first and second electrode means being electrically insulated from the other components of said locking mechanism; and an electrical tamper-detection circuit connected across said first and second electrode means and operative to generate an electrical signal response in the event said first electrode means is caused to engage said second electrode means.

2. An improved locking mechanism as recited in claim 1 wherein spring-loaded detent means is provided to normally maintain said cylinder in a predetermined position relative to said fixed body so that said tumblers normally extend into said slots but spatially separated from said second electrode means.

3. An improved locking mechanism as recited in claim 2 wherein the slots are sized so as to receive the tumblers in a close fit such that a relatively small movement of the tumblers will cause the first and second electrode means to engage each other.

4. An improved locking mechanism comprising:

a fixed body including at least one tumbler blocking member;

a further body for sliding movement relative to said fixed body and operative to perform a locking function;

a plurality of tumblers for individual engagement by a key and for movement thereby between a first position in which movement of said further body relative to said fixed body is prevented by engagement of at least one of said tumblers with said blocking member, and a second position in which no tumbler engages said blocking member and sliding movement of said further body is permitted;

first electrode means formed by at least one of said tumblers;

second electrode means formed by said blocking member, at least one of said first and second electrode means being electrically insulated from the other components of said locking mechanism; and an electrical tamper-detection circuit connected across said first and second electrode means and operative to generate an electrical signal response in the event said first electrode means is caused to engage said second electrode means.

5. An improved locking mechanism as recited in claim 4 wherein said locking mechanism is of the lever-tumbler type and wherein said blocking member is formed by a bolt post carried by said further body.

6. An improved locking mechanism as recited in claim 5 wherein said second electrode means is formed on at least one side of said bolt post.

* * * * *